United States Patent [19]

Smith

[11] Patent Number: 4,854,002

[45] Date of Patent: Aug. 8, 1989

[54] GUTTER BROOM WITH LOCKING MECHANISM

[76] Inventor: Keith E. Smith, 1612 S. Combee Rd., Lakeland, Fla. 33801

[21] Appl. No.: 43,606

[22] Filed: Mar. 24, 1987

[51] Int. Cl.[4] ..... A46B 13/02; A46B 17/02

[52] U.S. Cl. ..... 15/176.6; 15/180

[58] Field of Search ..... 15/180, 87, 202, 194, 15/146, 147 R, 176, 176.1, 176.2, 176.3, 176.4, 176.5, 176.6, 179, 181, 182, 183, 50 R, 49 R, 21 R, 21 A, 21 B, 21 C, 21 D, 21 E, 28, 29; 74/520; 292/DIG. 49; 269/254 R, 224; 16/293

[56] References Cited

U.S. PATENT DOCUMENTS

| | | | |
|---|---|---|---|
| Re. 14,741 | 10/1919 | Anderson | 292/DIG. 49 |
| 1,564,226 | 12/1925 | Finnell | 15/180 |
| 1,693,919 | 12/1928 | Gillis | 15/146 |
| 1,870,232 | 8/1932 | Brim | 15/49 R |
| 1,875,229 | 8/1932 | Falcke | 74/520 |
| 2,242,577 | 5/1941 | Finnell | 15/180 |
| 2,497,860 | 2/1950 | Brown | 74/520 |
| 2,542,709 | 2/1951 | Rowland | 15/183 X |
| 2,626,032 | 1/1953 | Coupsey | 74/520 |
| 2,853,729 | 9/1958 | Link | 15/180 |
| 3,212,347 | 10/1965 | Robeson | 74/520 |
| 3,758,908 | 9/1973 | Maltard | 15/180 |
| 3,875,607 | 4/1975 | Rosseau | 15/180 |
| 3,997,203 | 12/1976 | Fachbach | 242/DIG. 49 |
| 4,092,758 | 6/1978 | Horton et al. | 15/180 |

*Primary Examiner*—Harvey C. Hornsby
*Assistant Examiner*—Scott J. Haugland
*Attorney, Agent, or Firm*—Berman, Aisenberg & Platt

[57] ABSTRACT

A carrier plate for a broom includes a plurality of latches, each of which engages a broom block segment. A latch comprises a pivotally mounted arm and a spring which engages a rear surface of a broom block segment when in a closed position. The spring is extended to cause a compressive force to hold the arm in the closed position. A lever may be inserted into the arm to rotate the arm to an open position whereby the broom block segment is released to allow a replacement block to be installed.

14 Claims, 2 Drawing Sheets

FIG. 1
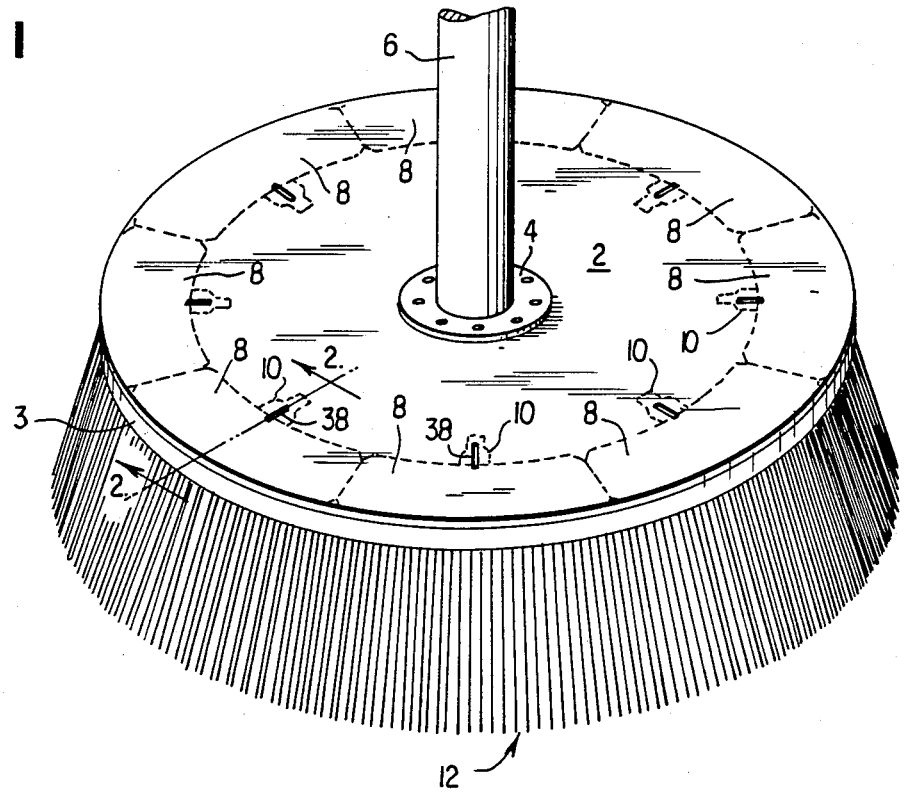
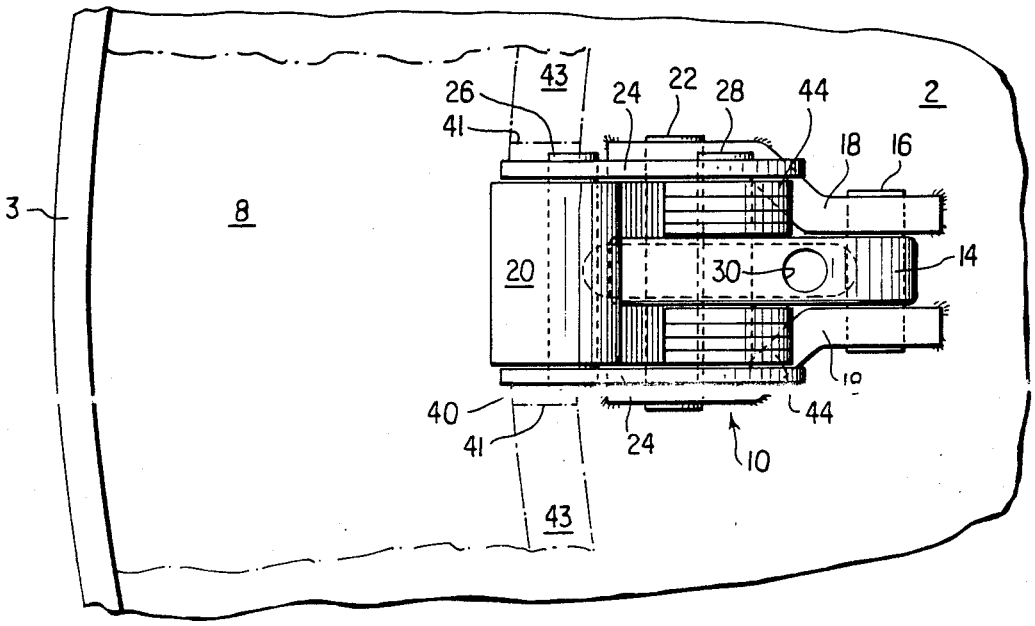
FIG. 4

GUTTER BROOM WITH LOCKING MECHANISM

TECHNICAL FIELD

This invention relates to a broom, and in particular to a carrier plate and broom block for a gutter broom.

BACKGROUND ART

Brooms employing a carrier plate and a plurality of brush block segments are known. For example, U.S. Pat. No. 1,564,226 (Finnell) shows a brush for a scrubbing machine wherein a circular metal plate has a downwardly extending flange along its perimeters and a plurality of latches, each of which secures a brush block segment. The latches are cams mounted for rotation about a vertical axis.

U.S. Pat. No. 3,181,193 (Nobles et al.) shows a brush similar to that of Finnell. The Nobles et al. patent shows a backing disk with an inwardly projecting flange which engages a groove in a brush block segment. U.S. Pat. No. 3,875,607 (Rosseau) shows a gutter brush wherein a brush block segment is engaged by a holder which is in turn attached to a carrier plate. The holder comprises a latch and an inwardly directed lip which engages a groove of a brush block segment. The latch forces an inwardly-located bead of the brush block segment upwardly, and a camming surface of the holder causes the brush block segment to move outwardly as it moves upwardly in response to operation of the latch.

U.S. Pat. No. 2,649,603 (Segesman) shows a strip-like brush mounted in a recess in a cylindrical holder. The brush is held in the recess by a clamping plate secured to the holder by a screw. U.S. Pat. No. 2,853,729 (Link) teaches a gutter broom wherein blocks are secured to a carrier with bolts. U.S. Pat. No. 3,023,440 (Peabody et al) shows a plurality of brushes mounted to brackets which are in turn mounted to a common plate.

SUMMARY OF THE INVENTION

In accordance with the invention, a carrier plate includes a downwardly directed peripheral edge and has secured thereto a spring latch which may be easily operated from above the carrier plate.

The latch comprises a spring plate pivotally mounted to the carrier plate and to an arm which is also pivotally mounted to the carrier plate. In the prefered embodiment, the spring is pivotally attached to the arm by a link. The arm includes a cylindrical opening for receiving an operating lever which passes through a slot in the carrier plate to allow the arm to be rotated by an operator from above the carrier plate.

A plurality of broom block segments is located along the circumference of the carrier plate, and a latch is provided for each broom block segment.

Installation of a broom block segment is accomplished by placing the segment in a position wherein the upper surface of the segment engages the bottom surface of the carrier plate and a front surface of the segment engages the downwardly extending edge. Then, the arm is rotated by actuation of the lever to cause the spring to engage a rear surface of the broom block segment. The arm is rotated further after the spring engages the rear surface of the segment to cause the spring ot be extended. The compression force supplied by the spring causes the arm to rotate into a closed position, thus securely holding the broom block segment without the application of bolts, cotter pins, or the like.

It is an object of this invention to provide an improved broom assembly wherein a latch is easily manipulated between open and closed positions.

A further object of this invention is to provide an improved carrier plate for a gutter broom wherein a latch includes a spring which engages one of a plurality of broom block segments and holds a latching mechanism in a closed position.

BRIEF DESCRIPTION OF THE DRAWINGS

FIG. 1 is a perspective view of a gutter broom in accordance with the invention.

FIG. 4 is a bottom view of a portion of the gutter broom shown in FIG. 1.

DETAILED DESCRIPTION OF THE INVENTION

Figure 2:
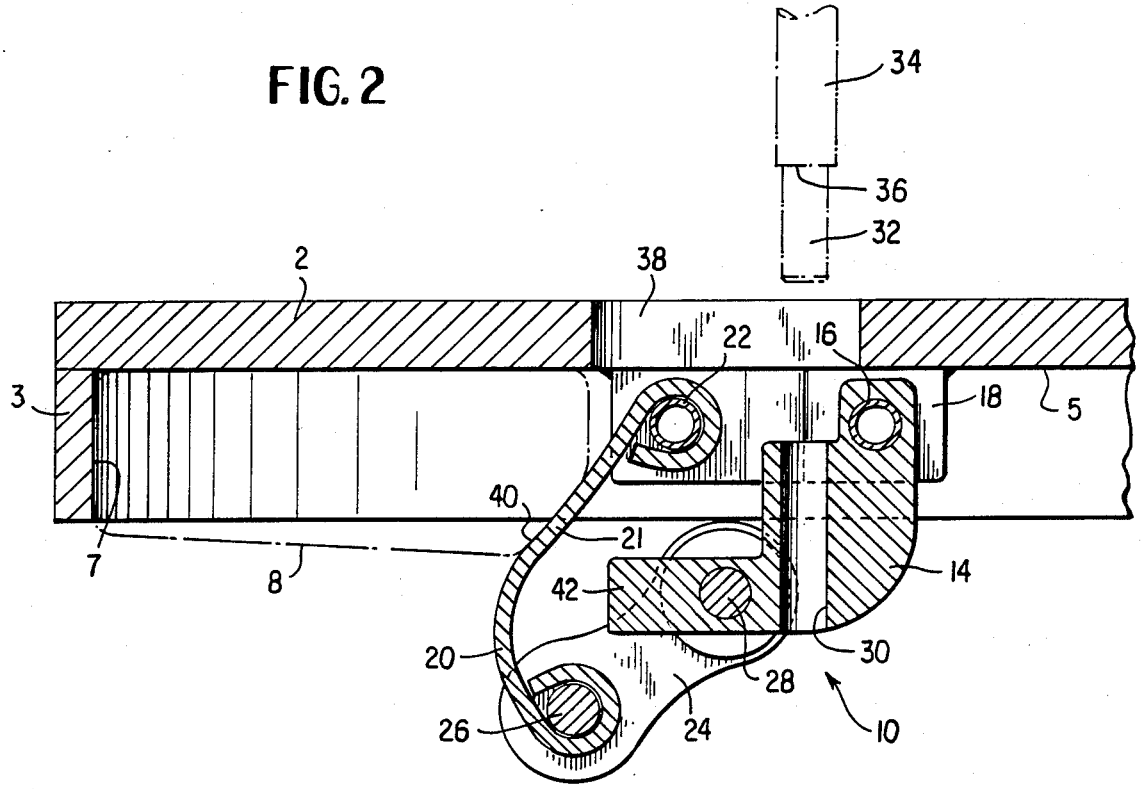
FIG. 2 is a cross-section taken along line 2—2 of FIG. 1.

With reference to FIG. 1, a carrier plate 2 is mounted to a flange 4 of a drive shaft 6 of a conventional street sweeper. A plurality of brush block segments 8 are attached to the underside of carrier plate 2. Each brush block segment 8 is secured to carrier plate 2 by a latch mechanism 10. Bristles 12 are held by respective brush block segments and extend downwardly from carrier plate 2 for engaging a street to be cleaned.

FIG. 2 is a cross-section taken along line 2—2 of FIG. 1 and shows a latch mechanism 10 in a partly-closed condition. A brush block segment 8 is shown in phantom lines, and bristles 12 have not been illustrated, for clarity. Carrier plate 2 includes a downwardly-extending edge 3, which is preferably a right cylinder. In the installed position shown in FIG. 2, an upper planar surface of brush block 8 engages the bottom surface 5 of carrier plate 2, and a curved front surface of the block 8 engages an inner surface 7 of edge 3.

Latch 10 includes an arm 14 pivotally connected to carrier plate 2 by a shaft 16 which extends between two mounting plates 18 and through a hole in arm 14. A spring 20 is pivotally mounted to carrier plate 2 by shaft 22, which also extends between mounting plates 18. A lower end of spring 20 is pivotally connected to arm 14. In a preferred embodiment, link 24 extends between pin 26 and pin 28, pin 26 pivotally receiving spring 20, and pin 28 extending through arm 14.

Arm 14 includes a cylindrical opening 30 for slidingly receiving an end portion 32 of lever 34. A shoulder 36 on lever 34 allows end portion 32 to be inserted into opening 30 by a predetermined amount. Lever 34 passes through a slot 38 in carrier plate 2, and slot 38 is elongated to allow lever 34 to rotate forwardly as shown in FIG. 3.

Figure 3:
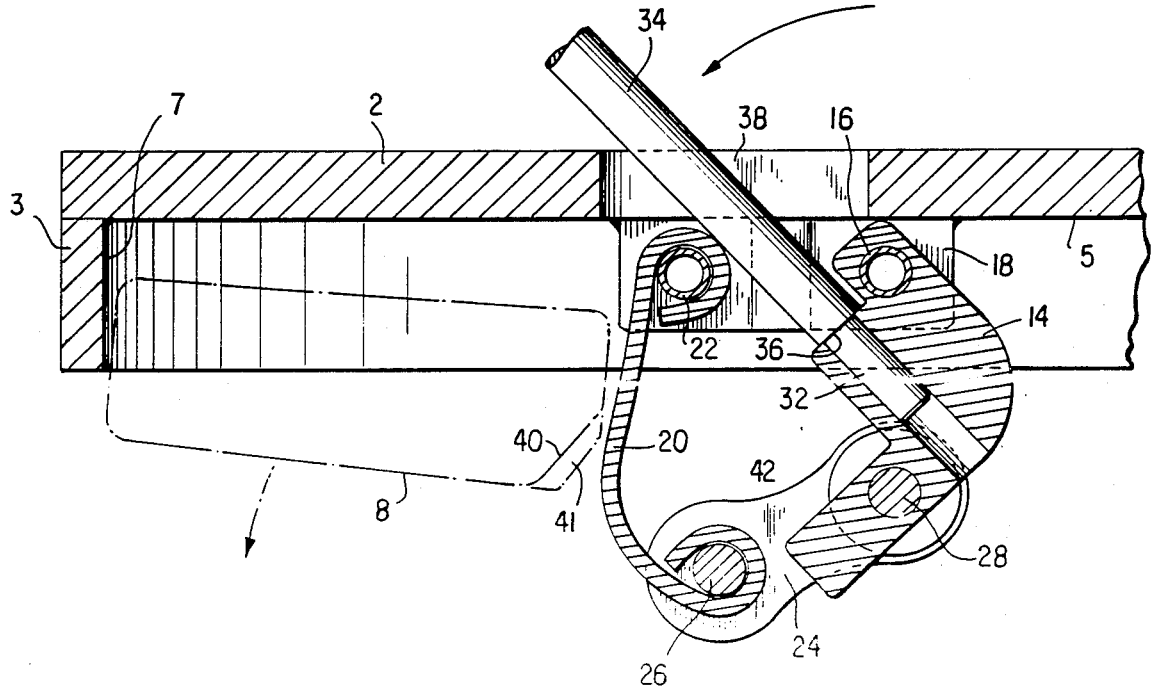
FIG. 3 is a cross-section taken along line 2—2 of FIG. 1 and showing a broom block latch in an open position.

With reference to FIG. 3, arm 14 has been rotated in a counterclockwise direction such that face 40 of broom block 8, which was engaged by spring 20 as shown FIG. 2, is disengaged from spring 20 to allow broom block segment 8 to be removed. A replacement broom block segment is easily installed by sliding it into engagement with carrier plate 2 and downwardly extending edge 3 and by rotating lever 34 in a clockwise direction to engage face 40 and spring 20. In a fully engaged position, bumper 42 of arm 14 engages a rear surface of spring 20. In this position, which is not illustrated in the drawings, arm 14 is rotated in a clockwise direction so that pins 26 and 28 are oriented to apply a compressive force of spring 20 to arm 14 to maintain the arm in a fully closed position. In the fully closed position, the ends of spring 20 are forced apart to provide a compression force holding bumper 42 of arm 14 against a rear face 21 of spring 20. In this position, bumper 42 adds an additional force to the face 40 of brush segment 8 by pressing against face 21 of spring 20.

FIG. 4 is a bottom view of a portion of the apparatus shown in FIG. 1. It will be appreciated that link 24 comprises two parallel spaced elements as does mounting plate 18. Surface 40 preferably lies at the base of a notch which includes sidewalls 41. Surfaces 43 form a larger angle with the top of broom block 8 than does surface 40. This notch cooperates with spring 20 to assist in retaining broom block 8 in a fixed radial position.

Spring 20 is preferably strap-shaped and has a width of approximately 1½ in. Spacers 44 may be placed on opposite sides of arm 14 to maintain the two elements of link 24 parallel.

It will be appreciated that the latching mechanism in accordance with the invention provides extremely efficient operation of a gutter broom. Removal of a broom block simply requires one to insert arm 34 in cylindrical opening 30 and to pull it toward the operator as shown in FIG. 3. Then, a worn brush block segment 8 is easily removed, and a replacement brush block 8 placed against carrier plate 2 and edge 3. Then, lever 34 is pushed away from the operator with one hand while the other hand supports the replacement brush block segment until spring 20 engages a surface of the replacement brush block segment, such as face 40. The lever is rotated further until arm 14 "snaps" into a closed position by the force of spring 20 causing bumper 42 to engage a rear face of spring 20. In this position, brush block segment 8 is securely held in position by the compressive force of spring 20.

Modifications of the invention within the scope of the appended claims will be apparent to those who are skilled in the art.

I claim:

1. A holder for a broom comprising plate means providing a first surface extending in a first direction, edge means extending transversely to said first surface and connected to said plate means to form a cavity for receiving a broom block, and latch means for engaging said broom block when said broom block is in said cavity, said latch means comprising actuator means pivotally attached to said plate means and resilient means having one part pivotally attached to said actuator means and a second part pivotally attached to said plate means, said resilient means engaging said broom block to hold said broom block in said cavity when said actuator means is in a first position and to hold said actuator in said first position and releasing said broom block from said cavity when said actuator means is in a second position.

2. A holder according to claim 1 wherein said edge means extends perpendicularly to said first surface.

3. A holder according to claim 1 wherein said actuator means comprises first and second parts pivotally connected to each other, said first part being pivotally connected to said plate means and said second part being pivotally connected to said resilient means.

4. A holder according to claim 3 wherein said resilient means is a strap having a surface portion for engaging a said broom block.

5. A holder according to claim 4 wherein said first part includes means for receiving an actuating handle.

6. A holder according to claim 5 wherein said means for receiving an actuating handle is a cylindrical aperture, and said plate includes a slot for allowing said actuating handle to pass therethrough to be received in said aperture.

7. A holder according to claim 6 wherein said plate means is a circular plate and said edge means is a right cylindrical strip attached to the periphery of said circular plate.

8. Apparatus according to claim 7 further comprising said broom block segment which comprises a body adapted to retain broom bristles and having a cylindrical outer edge, and an inner edge, said inner edge having a notch therein for receiving said resilient means.

9. A holder according to claim 7 wherein said actuator means is held in said first position by the resiliency of said resilient means.

10. A holder according to claim 9 wherein said second part is in an over-center position when said actuator is in said first position.

11. Apparatus for holding a plurality of broom segments comprising a circular plate having a generally flat bottom surface and a downwardly extending peripheral edge, a plurality of latch means mounted to said bottom surface radially inwardly of said edge, each of said latch means comprising a L-shaped arm having one end pivotally attached to said surface, a link pivotally mounted to one end of said arm, and a curved spring having one end pivotally mounted to said link and an opposite end pivotally mounted to said surface, said arm having a cylindrical opening and said plate having a slot aligned with said opening.

12. A broom block segment comprising a body having a substantially cylindrical outer edge and an inner edge, said inner edge having a notch therein for receiving a latch for securing said body to a carrier, wherein said notch comprises a downwardly and outwardly sloped generally flat surface extending from an innermost surface of said inner edge to a bottom surface of said body for engaging a surface of said latch and spaced sidewalls.

13. Apparatus according to claim 11 wherein said L-shaped arm is held in a first position by resiliency of said spring when said spring engages a broom segment and wherein said spring secures said broom segment to said circular plate when said L-shaped arm is in said first position.

14. Apparatus according to claim 13 wherein said link is in an over-center position when said L-shaped arm is in said first position.

* * * * *